United States Patent [19]

van der Heyden

[11] Patent Number: 4,828,430

[45] Date of Patent: May 9, 1989

[54] CONTROL SYSTEM

[75] Inventor: Henricus J. T. M. van der Heyden, Leiden, Netherlands

[73] Assignee: Heerema Engineering Service BV, Leiden, Netherlands

[21] Appl. No.: 155,369

[22] Filed: Feb. 12, 1988

[30] Foreign Application Priority Data

Feb. 12, 1987 [GB] United Kingdom ..... 8703223

[51] Int. Cl.[4] ..... E02D 23/08; E02B 17/02

[52] U.S. Cl. ..... 405/209; 405/203; 405/224; 405/195

[58] Field of Search ..... 405/195, 203–210, 405/224, 172; 254/277, 900

[56] References Cited

U.S. PATENT DOCUMENTS

| | | | |
|---|---|---|---|
| 3,512,657 | 5/1970 | Chambers | 254/277 X |
| 3,855,803 | 12/1974 | Lacroix | 405/206 |
| 4,126,298 | 11/1978 | Lub | 254/277 |
| 4,127,004 | 11/1978 | Vilain | 405/205 X |
| 4,293,239 | 10/1981 | Petty et al. | 405/195 |
| 4,303,352 | 12/1981 | Marion | 405/206 |
| 4,448,396 | 5/1984 | Delago | 254/900 X |
| 4,593,885 | 6/1986 | Hackman et al. | 254/900 X |
| 4,711,601 | 12/1987 | Grosman | 405/204 |

FOREIGN PATENT DOCUMENTS

| | | | |
|---|---|---|---|
| 1339131 | 11/1973 | United Kingdom | 254/900 |

*Primary Examiner*—Randolph A. Reese
*Assistant Examiner*—John Ricci
*Attorney, Agent, or Firm*—Fulwider Patton Rieber Lee & Utecht

[57] ABSTRACT

A method of controlling the vertical position of a body in water, where the body has or is given a positive buoyancy, providing a structure which is of sufficient weight to give the body negative buoyancy, providing a structure which is separate from the body and from which to support the load over the body, and providing a device for lowering the load into engagement with the body.

8 Claims, 15 Drawing Sheets

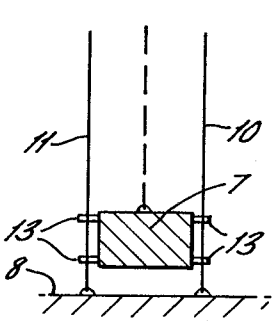
FIG. 2A.
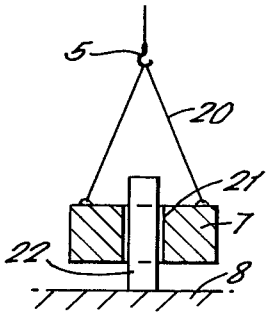
FIG. 2B.
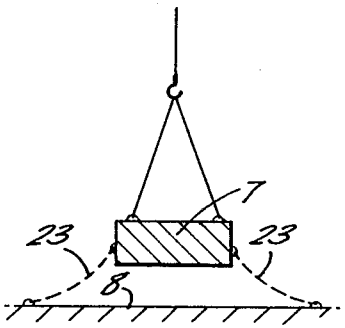
FIG. 2C.
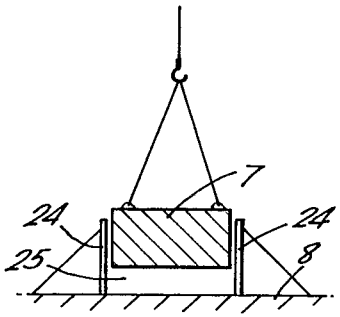
FIG. 2D.
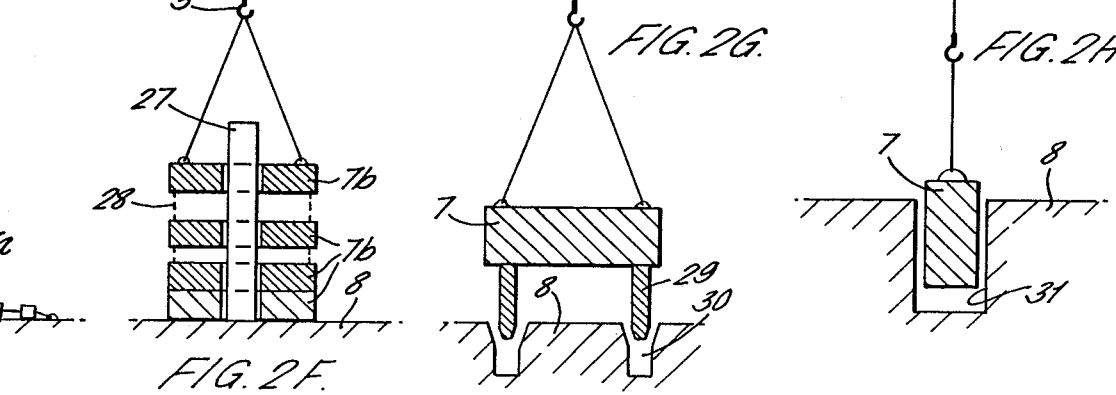
FIG. 2E.
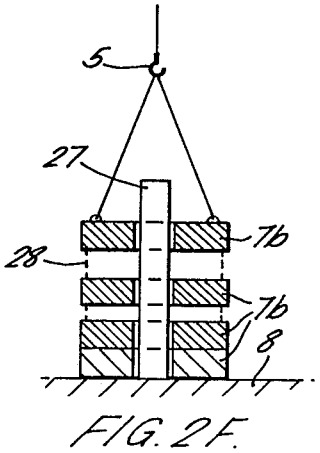
FIG. 2F.
FIG. 2G.
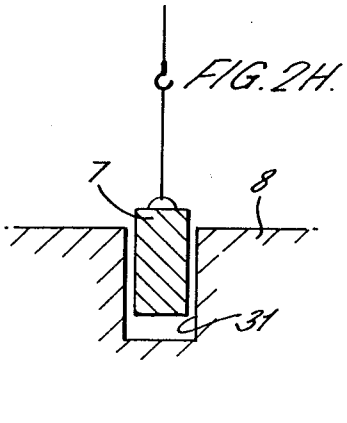
FIG. 2H.

CONTROL SYSTEM

This invention relates to a method of controlling the vertical position of a body in water.

BACKGROUND TO THE INVENTION

Large structures such as gravity bases for fixed platforms or for tension leg platforms have to be lowered to the sea bed in deep waters. The problem is how to provide control for the structure, as the structure goes below the surface of the water when lowered. Due to the size of such structures, their added mass is commonly very large, making them very inert. Control of such structures by the use of cranes which are connected rigidly to the structure can therefore lead to excessively high crane hook motions in the event of wave induced motions of the crane vessel.

BRIEF SUMMARY OF THE INVENTION

According to the present invention there is provided a method of controlling the vertical position of a body in water, where the body has or is given a positive buoyancy, including providing a load which is of sufficient weight to give the body negative buoyancy, providing a structure which is separate from the body from which to support the load over the body, and providing means for lowering the load into engagement with the body.

By way of example, embodiments of the invention will now be described with reference to the accompanying drawings.

BRIEF DESCRIPTION OF THE DRAWINGS

FIGS. 2A to 2H show alternative forms of guide for lateral location of the load.

DESCRIPTION OF THE PREFERRED EMBODIMENTS

Figure 1A:
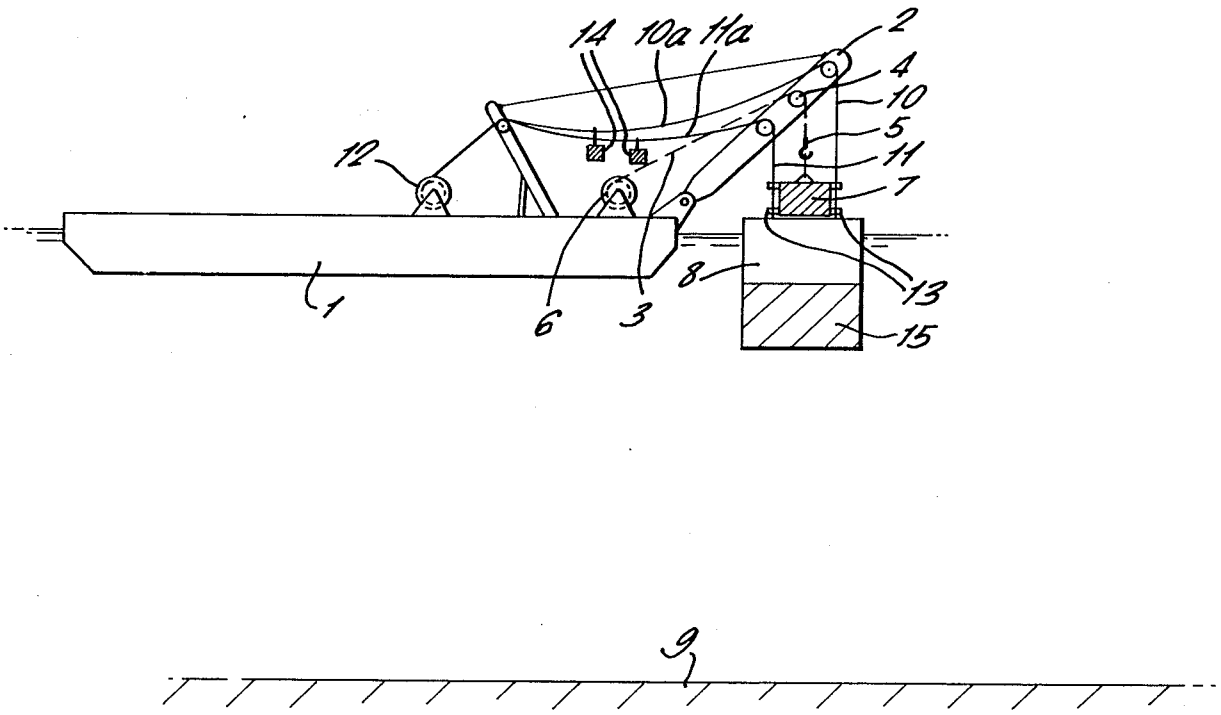
FIGS. 1A to 1D show steps in installation of a sub-sea module using one vessel.

There is seen in FIG. 1A a vessel 1 having a crane boom or jib or the like 2. A tension line 3, eg cable, wire, chain etc running over a pulley 4 on the jib 2 and having a hook 5 is lowerable using a winch 6. A load 7 is slung onto the hook 5. A sub-sea module 8, eg a template, is to be installed on the sea bed 9. Lines 10 and 11, eg cables, wires, chains etc, are connected to the module 8 and are paid out by a winch 12. The lines 10 and 11 serve as guides for lateral location of the load 7 relative to the module 8, the load having eyes 13 through which the lines 10 and 11 pass. Weights 14 are hung from the slack reaches 10A and 11A of lines 10 and 11 to serve as heave compensation devices and maintain even tension in the lines 10 and 11.

Figure 1B:
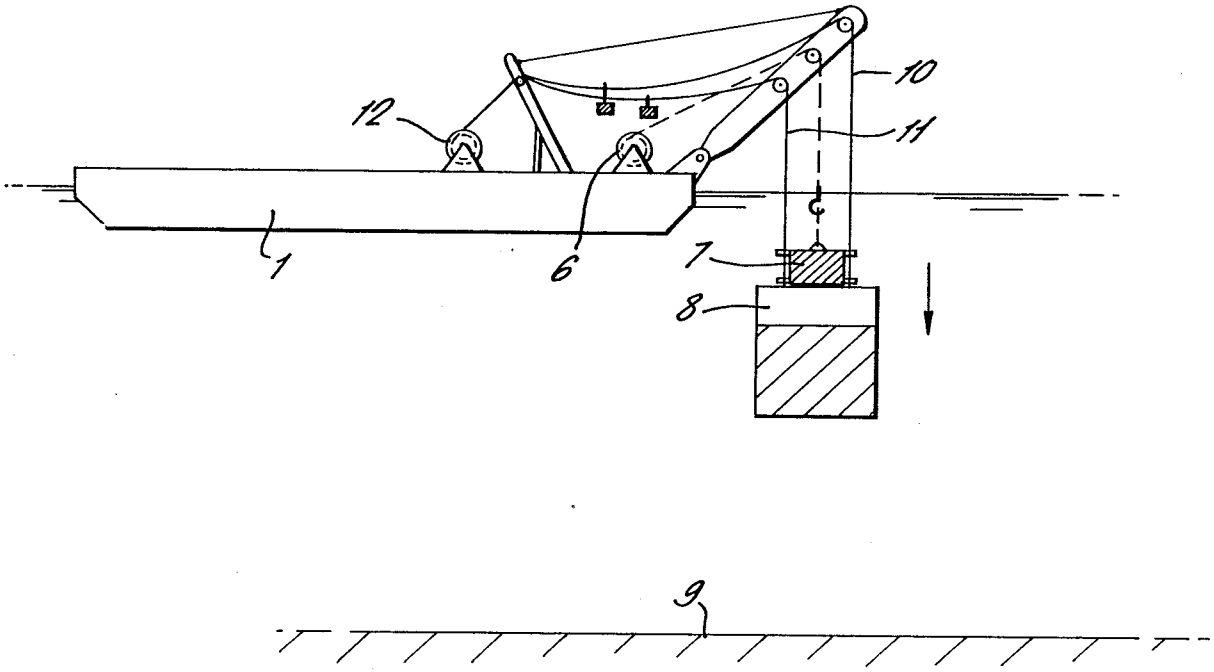

Module 8 is to be installed on the sea bed 9. The module 8 is flated out into location with the vessel 1 over the sea bed 9. Horizontal position control for the vessel is then effected, using anchors or thrusters or tugger lines etc. The module 8 has or is ballasted to a draft where it has a small positive buoyancy which is lower than the weight of the load 7. The ballast is indicated by 15. The load 7 is then lowered by winch 6 into engagement with the module 8 which then starts sinking due to the resultant negative buoyancy. This is seen happening in FIG. 1B. The guide lines 10 and 11 for the load 7 are simultaneously paid out by winch 12. The module 8 is then lowered further to the sea bed 9 under the control of winch 6.

Figure 1C:
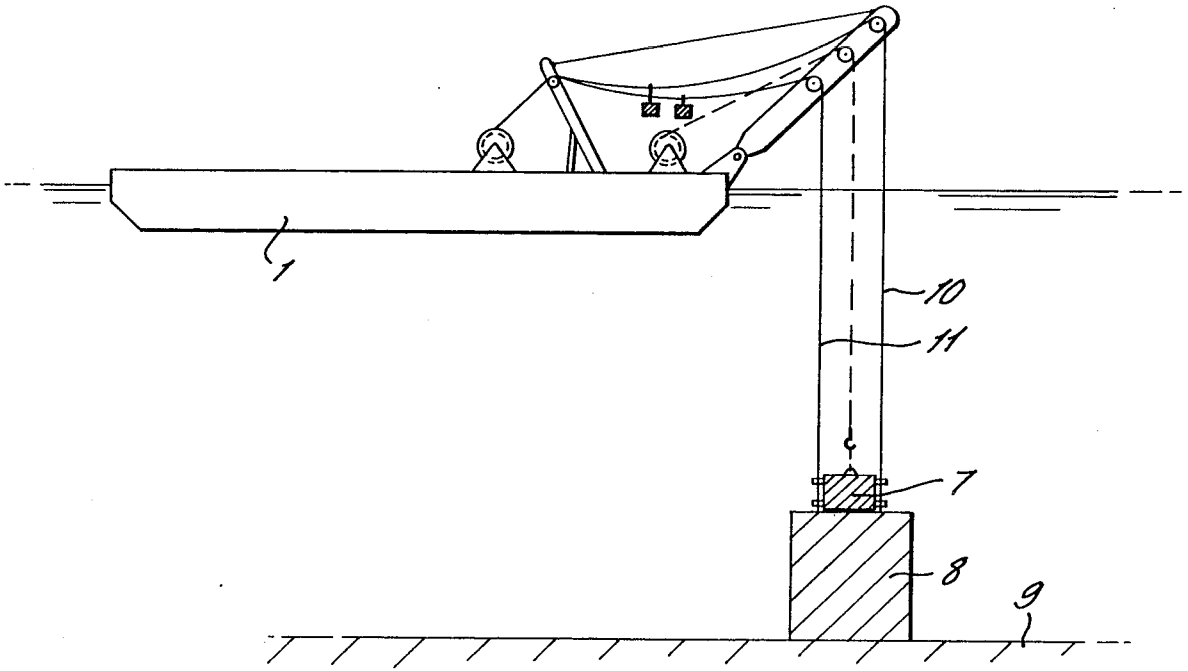

FIG. 1C indicates the position after setting down module 8 on the sea bed 9. The module 8 at this point is further ballasted, as is shown, and/or anchored to the sea bed to prevent its lifting off after removal of load 7. With the module 8 thus in position, the load 7 and lines 10 and 11 are removed.

During the course of lowering the load 7 and module 8, the vessel 1 may experience wave-induced vertical boom tip motions. This is seen happening in figure 1D. The weights 14 in the slack reaches 10A, 11A of lines 10 and compensate for the heave motion by simply maintaining tension in the lines 10 and 11. The heave motion of the vessel 1, however, causes the load 7 temporarily to lift off the module 8. Thus it wil be seen that the excess loading on the jibs 2 caused by vertical jib motions during installation is limited to approximately the weight (in air) of the load 7. If the module 8 was slung directly onto hook 5 and lowered, as is conventional, it will be seen that the excess loading on the jibs 2 caused by vessel motions could be at least as high as the weight (in air) of the module 8. For large modules, this would put an extremely high loading on the jib 2. Such high loading is avoided using the present system, which effectively provides a tension limiting device.

Figure 1D:
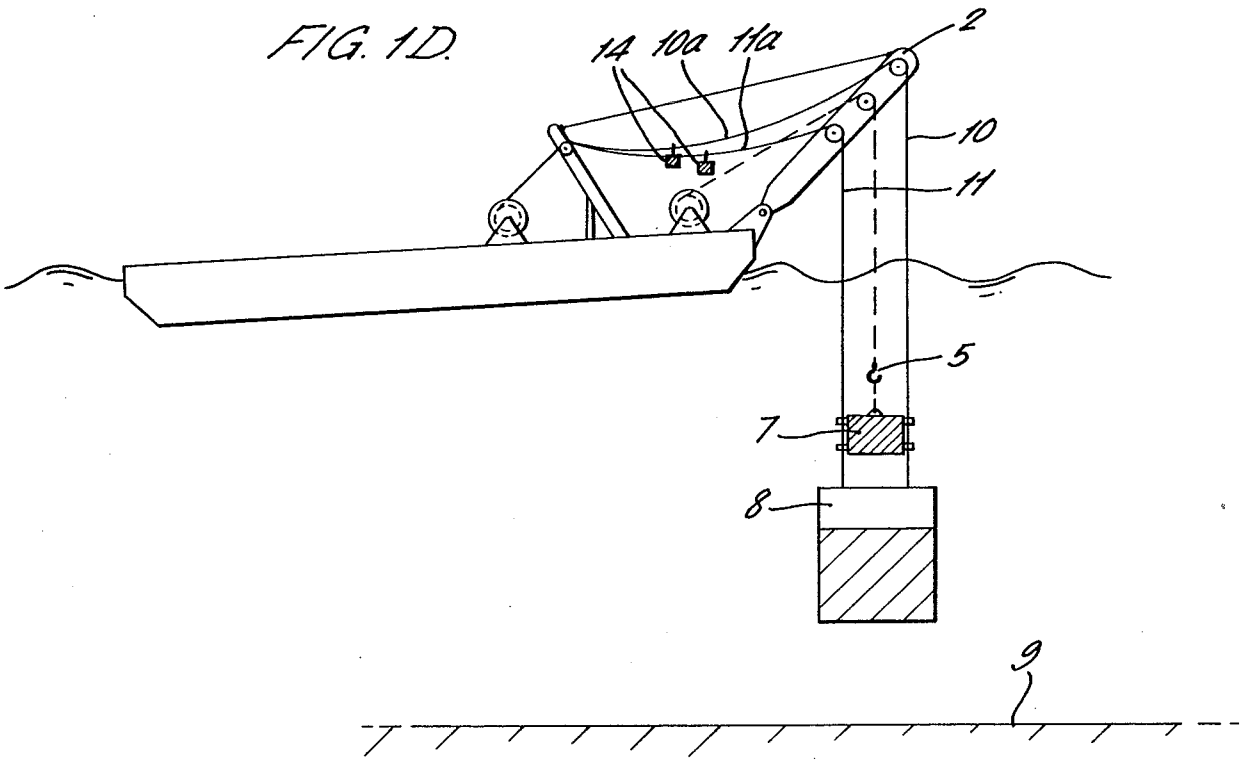

It will be further noted that, when load 7 rests on the module 8, the system is negatively buoyant (FIG. 1B) whereas when load 7 is hanging from the jib 2, the system is positively buoyant (FIG. 1D). This effectively means that the system is able to provide vertical position control of the module, eg for lowering onto the sea bed, as shown, or onto an underwater structure.

FIG. 2A shows in more detail the guide system for lateral location of the load 7 relative to the module 8. Lines 10 and 11 are slidably engaged in eyes 13 on the module 8. FIGS. 2B to 2H show possible alternative guide systems. In FIG. 2B, the load 7 is hung from the hook 5 by slings 20 and has a central hole 21. An upstanding shaft 22 is provided on the module 8 to be slidably received in the hole 21 in the load 7. In FIG. 2C, loose links 23 are connected between the module 8 and load 7. In FIG. 2D, side cheeks 24 on the module 8 provide a channel 25 to slidably receive the load 7. In FIG. 2E, a plurality of load units 7A are slung onto loose links 26 connected between the hook 5 and the module 8. In FIG. 2F, a plurality of toroidal load units 7B are slidably received on an upstanding shaft 27 on the module 8. The top load unit 7B is slung from the hook 5 and adjacent load units are connected to each other by loose links 28. In FIG. 2G, stabbing pins 29 extend downwardly from the load 7 and are engageable in holes 30 provided on the module 8. In FIG. 2H, an opening 31 is provided on the module 8 for receiving the load 7.

Figure 3A:
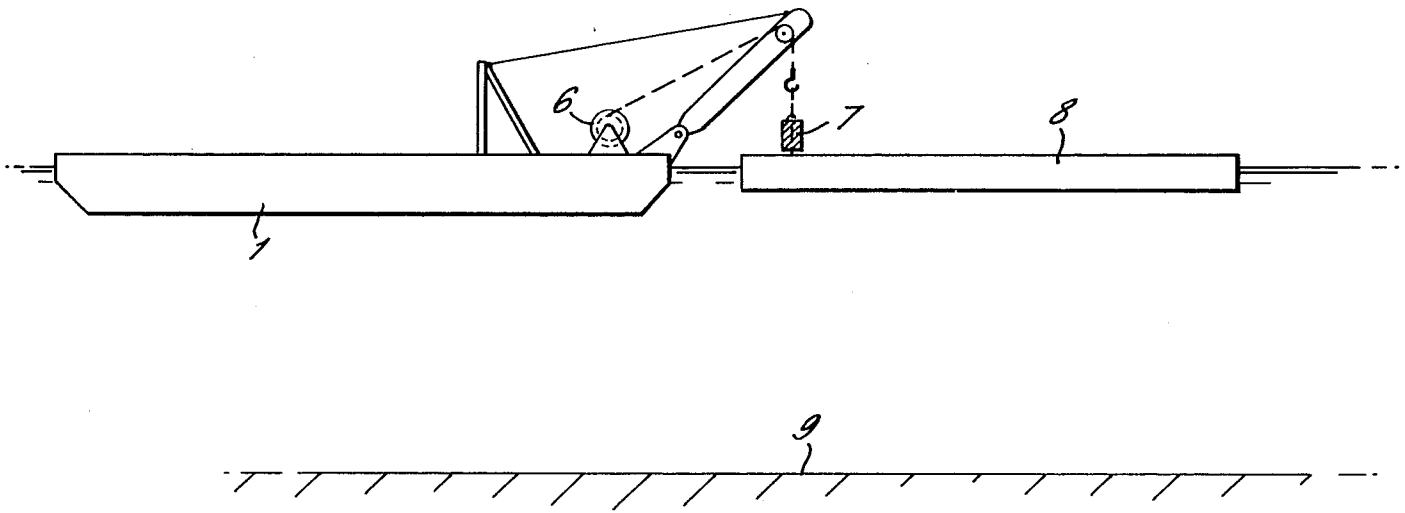
FIGS. 3A to 3C show steps in an alternative installation of a sub-sea module using one vessel.
Figure 3B:
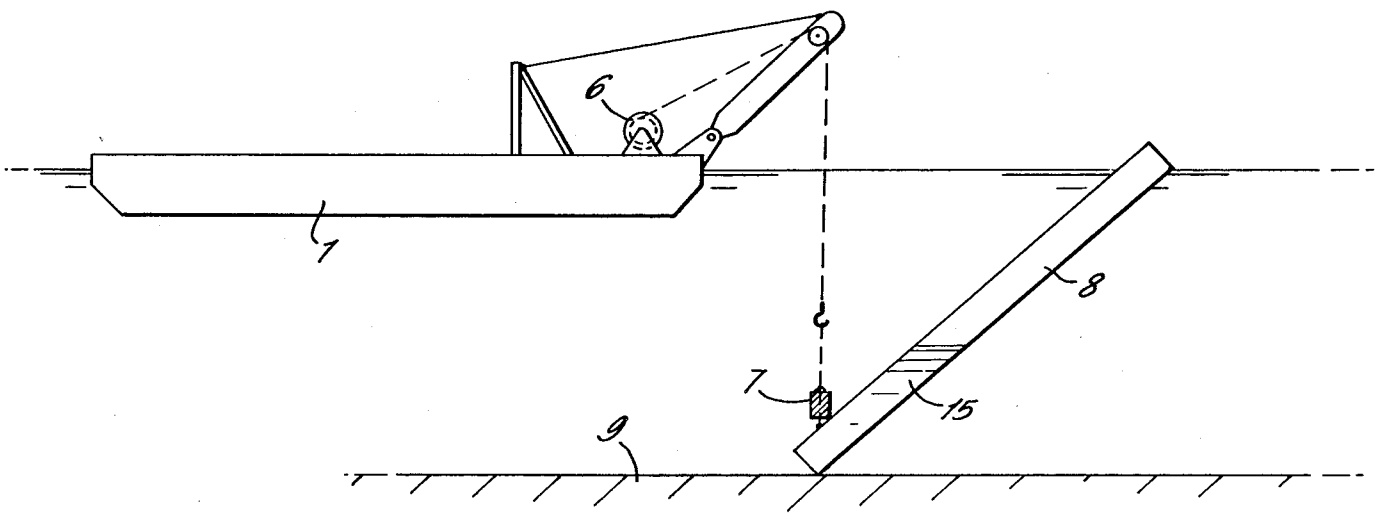
Figure 3C:
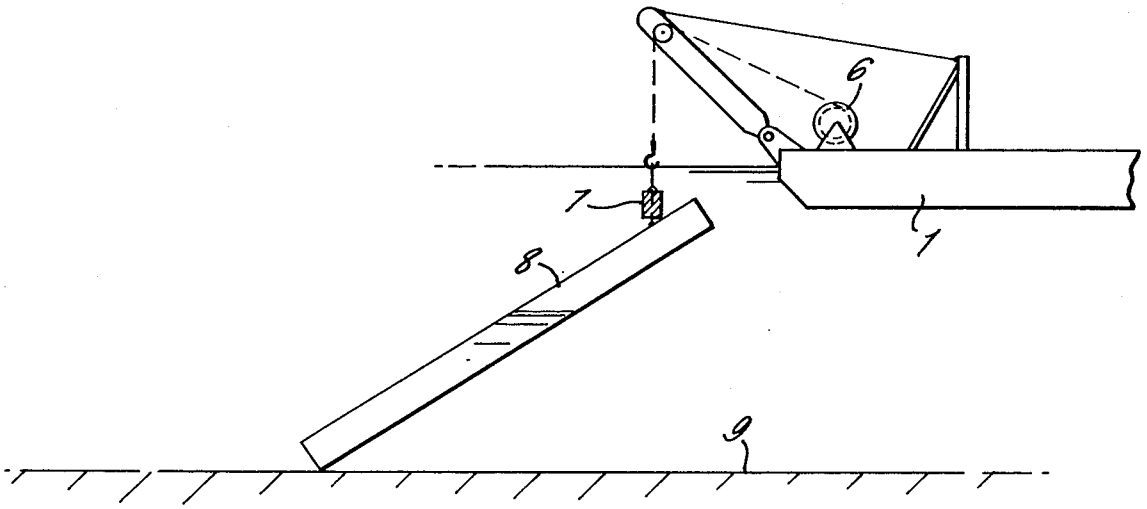

In FIGS. 3A to 3C there is seen a variation to the installation system of FIGS. 1A to 1D. The vessel 1 is again to install a module 8 on the sea bed 9 using a load 7 controlled by winch 6. The load 7 is located laterally relative to the module 8 by a guide system such as one of those shown in FIGS. 2A to 2H. The module 8 has or is ballasted to have a small positive buoyancy. Load 7 is of sufficient weight to give the module 8 negative buoyancy. The load 7 is lowered into engagement on the module 8, as is seen in FIG. 3A, offset from its centre of gravity, and lowered. This up-ends the module 8, as is seen in FIG. 3B. Since part of the module 8 is still above the surface of the water, additional stability is provided. In this position, the sunken end of the module 8 is held down by anchoring and/or with ballast 15. Then, a load 7 is applied to the still buoyant part of the module 8, as is seen in FIG. 3C, and lowered. This can be done by repositioning the same vessel 1 or using another vessel. When second load 7 has completely lowered the module 8 to the sea bed 9, the module is fully ballasted and/or anchored, the load is removed and installation is complete.

Figure 4A:
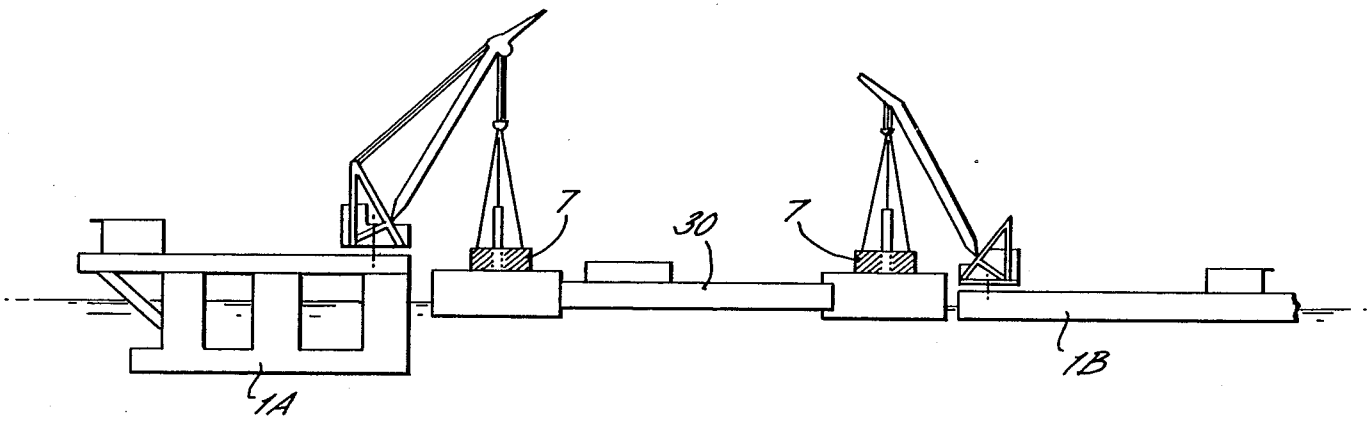
FIGS. 4A to 4D show steps in installation of a large offshore tower structure and foundation unit therefor using two vessels.
Figure 4B:
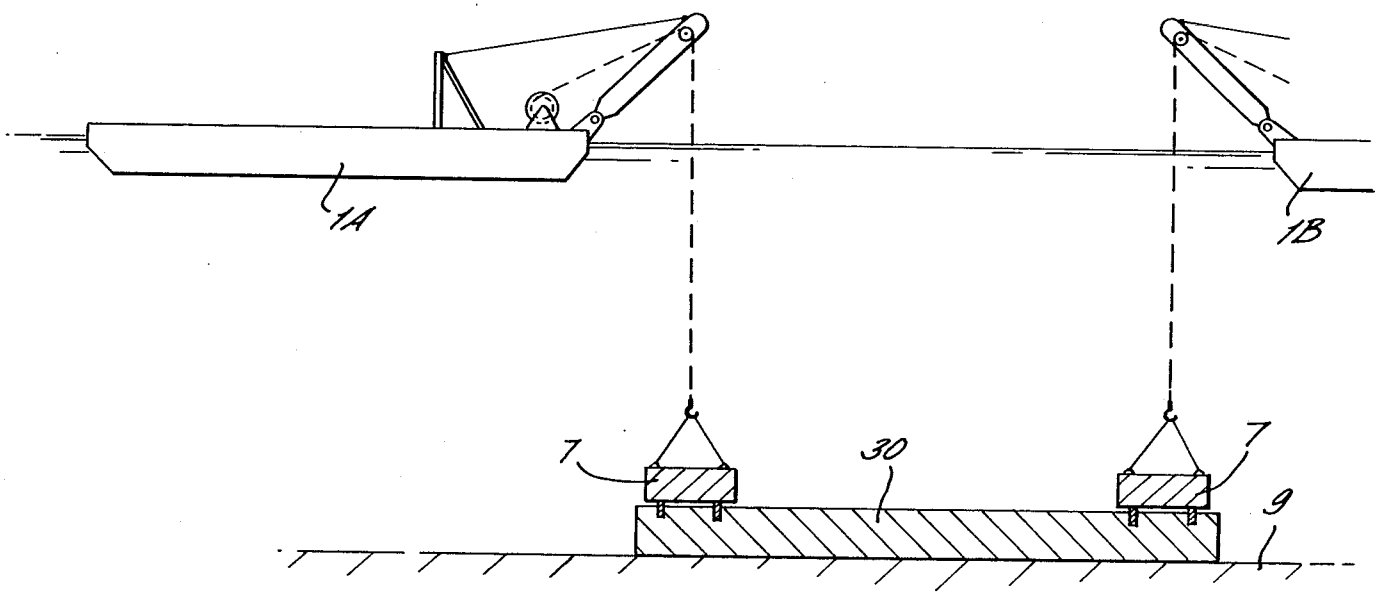
Figure 4C:
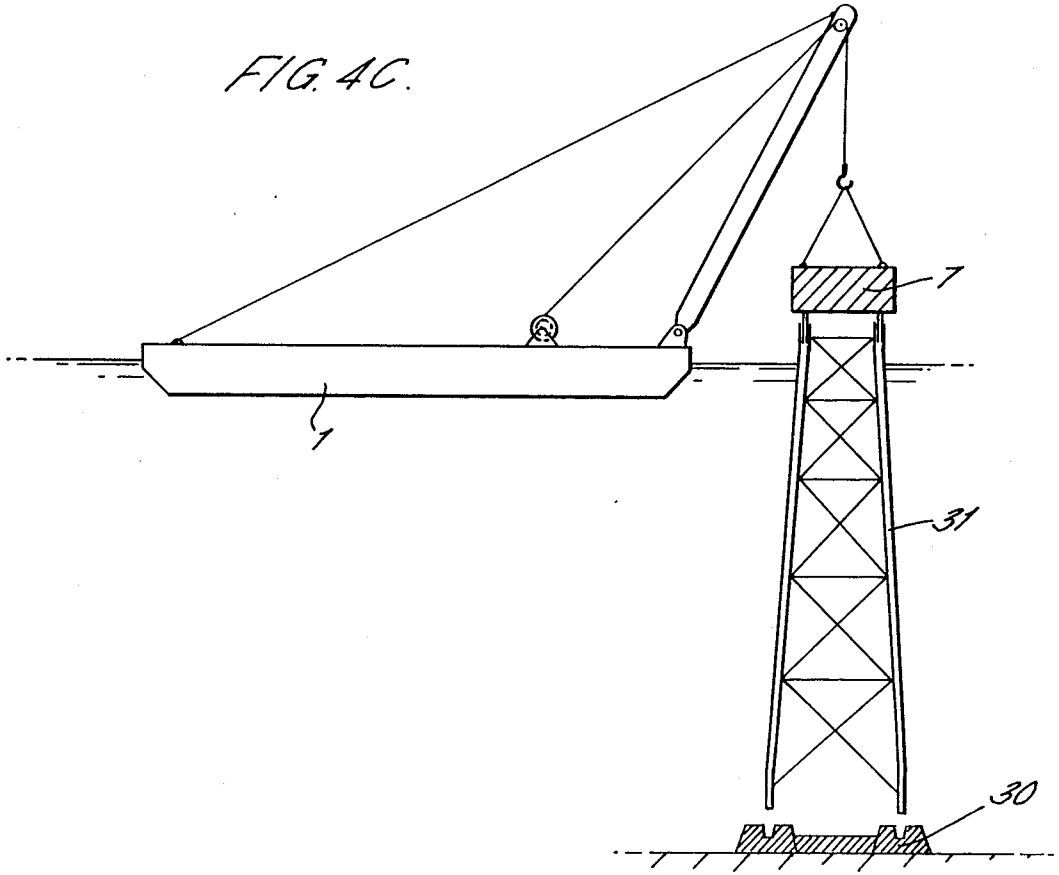
Figure 4D:
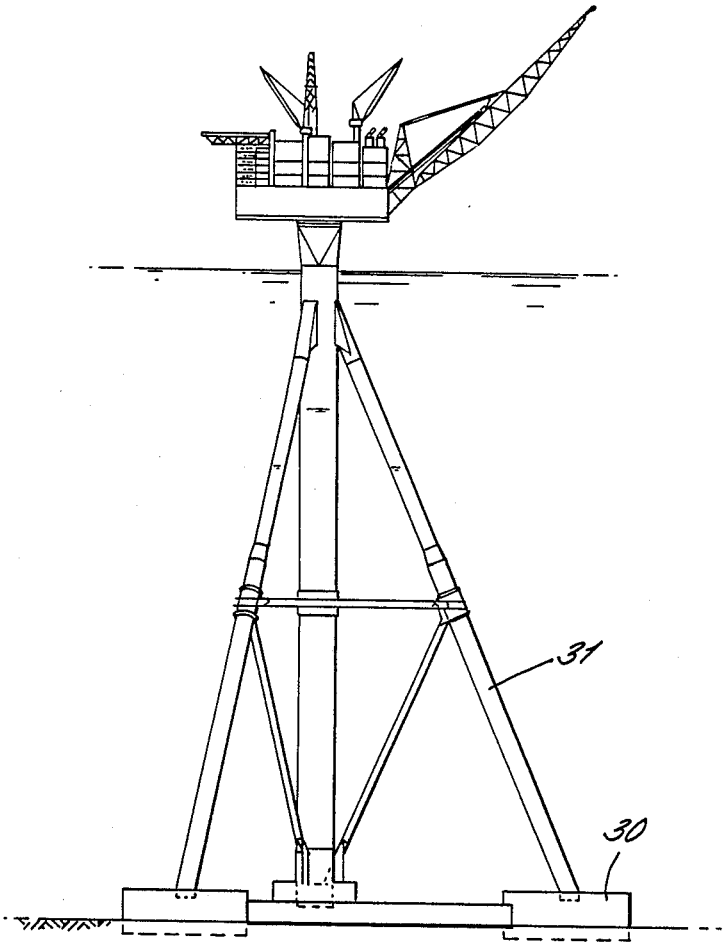

In FIGS. 4A to 4D there are seen the steps in installation of a large offshore tower structure and foundation unit. The foundation unit 30 is installed using two vessels 1A, 1B simultaneously. The two vesssels 1A, 1B are employed using the same system of lowering loads 7 as has been described above. Of course, more than two vessels may be used. FIG. 4B shows the situation after the foundation unit 30 has been lowered onto the sea bed 9 and fully ballasted. In FIG. 4C, a vessel 1 is seen installing the tower structure 31 on the already installed foundation unit 30. The tower structure 31 may, for example, have been constructed onshore or at a sheltered inshore location and floated out to the offshore site. The structure 31 is then up-ended into the position seen in FIG. 4D and ballasted as necessary to give it a small positive buoyancy. Load 7 is then applied according to the installation system as has been described to lower the structure 31 onto its foundation unit 30. When in position, the structure 31 is fully ballasted and/or anchored, the load is removed and installation is complete. In FIG. 4D there is seen a typical example of an offshore tower structure 31 on a foundation unit 30 erected using a system as described above.

It will be appreciated that the structure provided to support the load over the module or body may be fixed relative to the sea bed, instead of using the vessels shown. For example, the system may be used from platform jackets, fixed quays, jack-ups etc.

Figure 5:
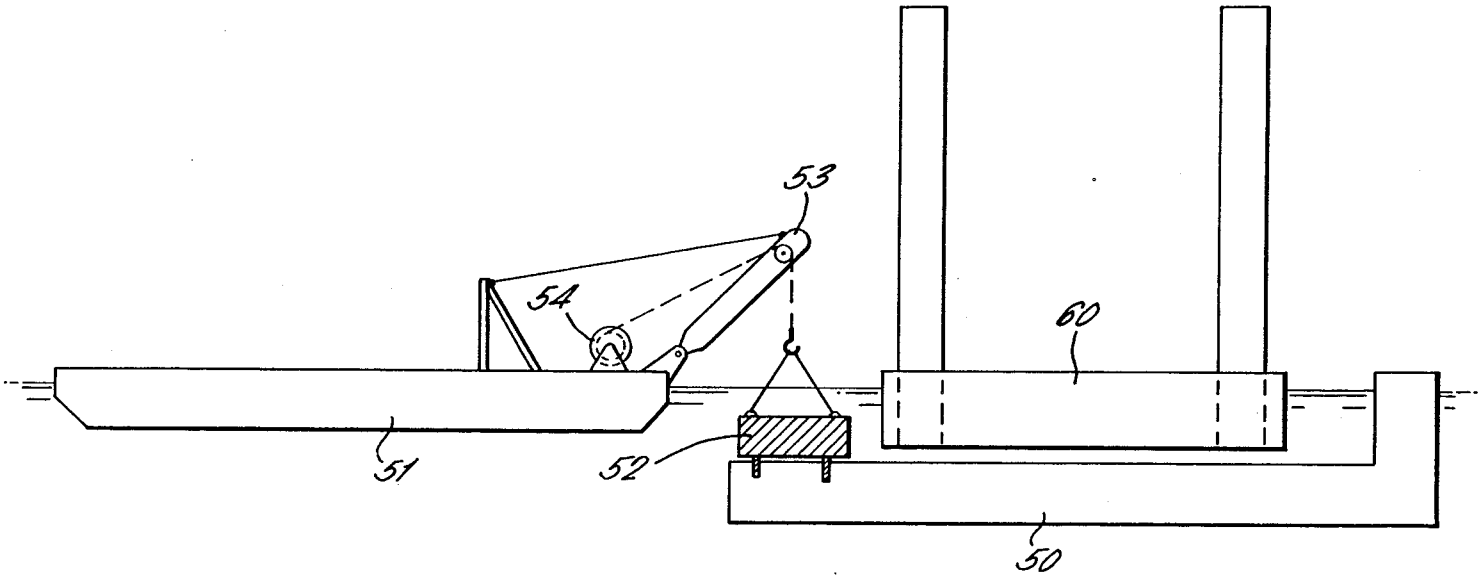
FIGS. 5 and 6 show vertical position control of a semi-submersible using one or two vessels.
Figure 6:
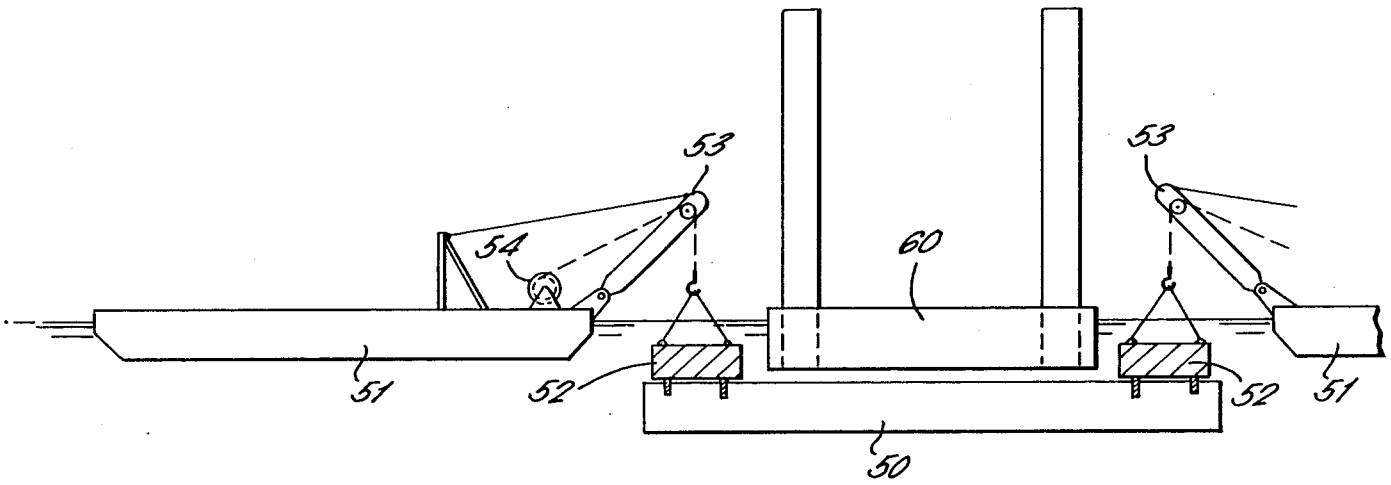

FIGS. 5 and 6 show use of the system to provide vertical position control for a submersible or semi-submersible dock or barge 50 during floating on or off the module 60. In FIG. 5, a single vessel 51 is used with load 52 suspended from a jibs 53 undercontrol from winch 54. In FIG. 6, two vessels 51 are used with loads 52 suspended from jibs 53 under control from winches 54.

Figure 7:
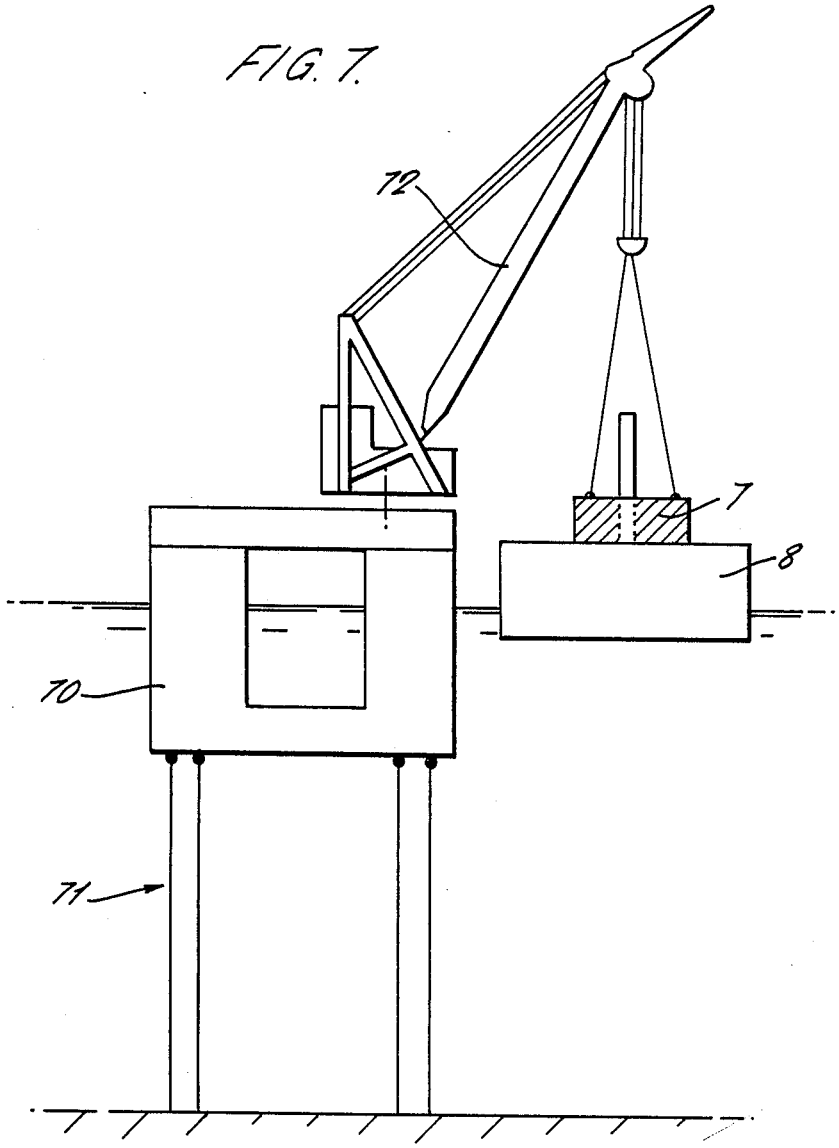
FIG. 7 shows use of the system on a tension leg platform.

FIG. 7 shows use of the system on a tension leg platform 70 having tension legs 71 and a crane or cranes 72.

What I claim is:

1. A method of controlling the vertical position of a body in water, where the body has or is given a positive buoyancy, including providing a load which is of sufficient weight to give the body negative buoyancy, providing a structure which is separate from the body from which to support the load over the body, and providing means for lowering the load into engagement with the body.

2. A method as claimed in claim 1 used to install the body on the sea bed or an underwater structure, including lowering the load into engagement with the body over its centre of gravity, lowering the load further until the body is sunk onto the sea bed or underwater structure, and anchoring the body to the sea bed or underwater structure or ballasting the body to have negative buoyancy to prevent the body lifting up when the load is removed.

3. A method as claimed in claim 1 used to install the body on the sea bed or an underwater structure, including lowering the load into engagement with the body offset from its centre of gravity, lowering the load further until part of the body is sunk onto the sea bed or underwater structure, anchoring that part of the body to the sea bed or underwater structure or ballasting that part of the body to prevent it lifting up when the load is removed, lowering another load or re-lowering the same load into engagement with the remaining part of the body, lowering the load further until the body is fully sunk onto the sea bed or underwater structure, and anchoring the body to the sea bed or underwater structure or ballasting the body so that it has negative buoyancy.

4. A method as claimed in claim 1 used to install a body on the sea bed or an underwater structure, including using two or more loads and one or more structures simultaneously to lower the body.

5. A method as claimed in claim 1 and further including providing means to locate the load laterally relative to the body.

6. A method as claimed in claim 5 wherein said load locating means is connected between the body and the structure and comprises means to compensate for wave induced motion of the structure and/or the body.

7. A method as claimed in claim 1 and further including providing means to absorb impacts between the load and the body.

8. A method as claimed in claim 1 wherein said structure is a floating body.

* * * * *